US009528351B2

(12) United States Patent
Vidma et al.

(10) Patent No.: US 9,528,351 B2
(45) Date of Patent: Dec. 27, 2016

(54) GRAVEL AND FRACTURE PACKING USING FIBERS

(75) Inventors: Konstantin Viktorovich Vidma, Novosibirsk (RU); Mohan K. R. Panga, Novosibirsk (RU); Balkrishna Gadiyar, Katy, TX (US); Anatoly Medvedev, Moscow (RU); Ivan Sergeyevich Glaznev, Novosibirsk (RU); Raymond J. Tibbles, Kuala Lumpur (MY); Michael J. Fuller, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 582 days.

(21) Appl. No.: 13/567,916

(22) Filed: Aug. 6, 2012

(65) Prior Publication Data

US 2013/0199782 A1 Aug. 8, 2013

Related U.S. Application Data

(60) Provisional application No. 61/560,545, filed on Nov. 16, 2011, provisional application No. 61/640,429, filed on Apr. 30, 2012.

(51) Int. Cl.

| | |
|---|---|
| ***E21B 43/08*** | (2006.01) |
| ***E21B 43/267*** | (2006.01) |
| ***E21B 43/04*** | (2006.01) |
| *E21B 43/10* | (2006.01) |

(52) U.S. Cl.

CPC ..... *E21B 43/08* (2013.01); *E21B 43/04* (2013.01); *E21B 43/267* (2013.01); *E21B 43/10* (2013.01)

(58) Field of Classification Search

CPC ..... E21B 33/13; E21B 43/04; E21B 43/10; E21B 43/08; E21B 43/267

See application file for complete search history.

(56) References Cited

U.S. PATENT DOCUMENTS

| | | | |
|---|---|---|---|
| 5,330,005 | A | 7/1994 | Card et al. |
| 5,439,055 | A | 8/1995 | Card et al. |
| 5,501,274 | A | 3/1996 | Nguyen et al. |
| 5,501,275 | A | 3/1996 | Card et al. |
| 5,551,514 | A | 9/1996 | Nelson et al. |

(Continued)

FOREIGN PATENT DOCUMENTS

| | | | |
|---|---|---|---|
| EP | 0834644 | A2 | 4/1998 |
| EP | 1398460 | A1 | 3/2004 |

(Continued)

OTHER PUBLICATIONS

E. Barmatov, et al. Setting the Standard for Resin Coated Proppant Testing, (2008) SPE 115547, pp. 1-14.

(Continued)

*Primary Examiner* — Nicole Coy
(74) *Attorney, Agent, or Firm* — Jeffery R. Peterson

(57) ABSTRACT

A technique includes completing a well, including installing a tubing string that includes a screen in the well and installing a fiber-based material outside of the screen. The technique further includes using the well as an injection well, including communicating a fluid into the tubing string to cause an injection flow to be communicated in a fluid flow path from an interior of the tubing string, through the screen and into a formation.

21 Claims, 7 Drawing Sheets

(56) References Cited

U.S. PATENT DOCUMENTS

| | | | | |
|---|---|---|---|---|
| 5,582,249 | A | 12/1996 | Caveny et al. | |
| 5,775,425 | A | 7/1998 | Weaver et al. | |
| 5,787,986 | A | 8/1998 | Weaver et al. | |
| 5,833,000 | A | 11/1998 | Weaver et al. | |
| 5,839,510 | A | 11/1998 | Weaver et al. | |
| 5,853,048 | A | 12/1998 | Weaver et al. | |
| 5,871,049 | A | 2/1999 | Weaver et al. | |
| 5,908,073 | A | 6/1999 | Nguyen et al. | |
| 5,960,878 | A | 10/1999 | Nguyen et al. | |
| RE36,466 | E | 12/1999 | Nelson et al. | |
| 6,047,772 | A | 4/2000 | Weaver et al. | |
| 6,172,011 | B1 | 1/2001 | Card et al. | |
| 6,209,643 | B1 | 4/2001 | Nguyen et al. | |
| 6,439,309 | B1 | 8/2002 | Matherly et al. | |
| 6,742,590 | B1 | 6/2004 | Nguyen et al. | |
| 6,877,560 | B2 | 4/2005 | Nguyen et al. | |
| 6,892,813 | B2 | 5/2005 | Nguyen et al. | |
| 6,899,176 | B2 * | 5/2005 | Hailey et al. | 166/278 |
| 7,032,667 | B2 | 4/2006 | Nguyen et al. | |
| 7,040,403 | B2 | 5/2006 | Nguyen et al. | |
| 7,044,220 | B2 | 5/2006 | Nguyen et al. | |
| 7,063,151 | B2 | 6/2006 | Nguyen et al. | |
| 7,086,460 | B2 | 8/2006 | Nguyen et al. | |
| 7,178,596 | B2 | 2/2007 | Blauch et al. | |
| 7,228,904 | B2 | 6/2007 | Todd et al. | |
| 7,261,156 | B2 | 8/2007 | Nguyen et al. | |
| 7,264,051 | B2 | 9/2007 | Nguyen et al. | |
| 7,267,170 | B2 | 9/2007 | Mang et al. | |
| 7,318,474 | B2 | 1/2008 | Welton et al. | |
| 7,350,571 | B2 | 4/2008 | Nguyen et al. | |
| 7,407,010 | B2 | 8/2008 | Rickman et al. | |
| 2003/0062160 | A1 * | 4/2003 | Boney et al. | 166/278 |
| 2003/0089496 | A1 | 5/2003 | Price-Smith et al. | |
| 2003/0230408 | A1 | 12/2003 | Acock et al. | |
| 2004/0149441 | A1 | 8/2004 | Nguyen et al. | |
| 2005/0011648 | A1 | 1/2005 | Nguyen et al. | |
| 2005/0049151 | A1 | 3/2005 | Nguyen et al. | |
| 2005/0051332 | A1 | 3/2005 | Nguyen et al. | |
| 2005/0130848 | A1 | 6/2005 | Todd et al. | |
| 2005/0145385 | A1 | 7/2005 | Nguyen et al. | |
| 2005/0194135 | A1 | 9/2005 | Nguyen et al. | |
| 2005/0194136 | A1 | 9/2005 | Nguyen et al. | |
| 2005/0194137 | A1 | 9/2005 | Nguyen et al. | |
| 2006/0016449 | A1 | 1/2006 | Eicher et al. | |
| 2006/0151168 | A1 | 7/2006 | Nguyen et al. | |
| 2010/0212898 | A1 * | 8/2010 | Nguyen | C08G 77/04 166/280.1 |
| 2010/0263870 | A1 | 10/2010 | Willberg et al. | |

FOREIGN PATENT DOCUMENTS

| | | | |
|---|---|---|---|
| EP | 1447523 | A1 | 8/2004 |
| WO | 2004067909 | A1 | 8/2004 |
| WO | 2005000993 | A1 | 1/2005 |
| WO | 2005024181 | A1 | 3/2005 |
| WO | 2005066457 | A1 | 7/2005 |
| WO | 2006032833 | A1 | 3/2006 |
| WO | 2007076389 | A2 | 7/2007 |
| WO | 2009076389 | A1 | 6/2009 |
| WO | 2009078744 | A1 | 6/2009 |
| WO | 2009078745 | A1 | 6/2009 |
| WO | 2009079231 | A2 | 6/2009 |
| WO | 2009079231 | A3 | 6/2009 |
| WO | 2009079233 | A2 | 6/2009 |
| WO | 2009079233 | A3 | 6/2009 |
| WO | 2009079234 | A2 | 6/2009 |
| WO | 2009079234 | A3 | 6/2009 |
| WO | 2009079235 | A2 | 6/2009 |
| WO | 2009079235 | A3 | 6/2009 |
| WO | 2009088315 | A1 | 7/2009 |
| WO | 2009139660 | A1 | 11/2009 |

OTHER PUBLICATIONS

International Search Report and Written Opinion dated Mar. 26, 2013, issued in PCT/US2012/060370 filed Oct. 16, 2012 (12 pages).

Pitoni et al. Screenless Completions: Cost-Effective Sand Control in the Adriatic Sea; SPE 58787 (2000) 1-7.

Heitmann et al. Fiber-Enhanced Visco-Elasco Surfactant Fracturing Enables Cost-Effective Screenless Sand Control; SPE 78323 (2002) 1-10.

PropGuard; Fiber-based proppant flowback control, Schlumberger (2010) 2 pages.

PropNet: Proppant flowback control technology, Schlumberger (2001) 4 pages.

Acock et al. Screenless Methods to Control Sand; Oilfield Review (2003) 38-53.

* cited by examiner

GRAVEL AND FRACTURE PACKING USING FIBERS

This application claims the benefit under 35 U.S.C. §119 (e) to U.S. Provisional Patent Application Ser. No. 61/560,545 entitled, "GRAVEL PACK USING FIBERS FOR INJECTION OPERATIONS," which was filed on Nov. 16, 2011, and U.S. Provisional Patent Application Ser. No. 61/640,429 entitled, "GRAVEL AND FRACTURE PACKING USING FIBERS," which was filed on Apr. 30, 2012. Each of these applications is hereby incorporated by reference in its entirety.

BACKGROUND

A fluid producing well may extend into one or more subterranean formations that contain unconsolidated particulates, often referred to as "sand," which may migrate out of the formations with the produced oil, gas, water, or other fluid. If appropriate measures are not undertaken, the sand may abrade the well and surface equipment, such as tubing, pumps and valves. Moreover, the sand may partially or fully clog the well, inhibit fluid production, and so forth.

For purposes of controlling the sand production in a given zone, or stage, of a production well, a tubing string that communicates produced fluid from the well may contain a screen that is positioned in the stage. The screen may contain filtering media through which the produced fluid flows into the tubing string and which therefore inhibits sand from entering the inside of the tubing string. As another measure to control sand production, in the completion of the well, a gravel packing operation may be performed for purposes of depositing a gravel pack (proppant, for example) around the periphery of the screen. The gravel pack also serves to filter sand to prevent sand from entering the tubing string; and the gravel pack also serves to stabilize the wellbore. The gravel packing operation may be combined with a hydraulic fracturing operation in hydraulic pressure is used to fracture the surrounding formation and a fracture pack (proppant, for example) is deposited inside the fractures for purposes of holding the fractures open when the hydraulic pressure is released.

SUMMARY

The summary is provided to introduce a selection of concepts that are further described below in the detailed description. This summary is not intended to identify key or essential features of the claimed subject matter, nor is it intended to be used as an aid in limiting the scope of the claimed subject matter.

In accordance with example implementations, a technique includes completing a well, including installing a tubing string that includes a screen in the well and installing a fiber-based material outside of the screen. The technique further includes using the well as an injection well, including communicating a fluid into the tubing string to cause an injection flow to be communicated in a fluid flow path from an interior of the tubing string, through the screen and into a formation.

Advantages and other features will become apparent from the following drawing, description and claims.

DETAILED DESCRIPTION

Figure 1:
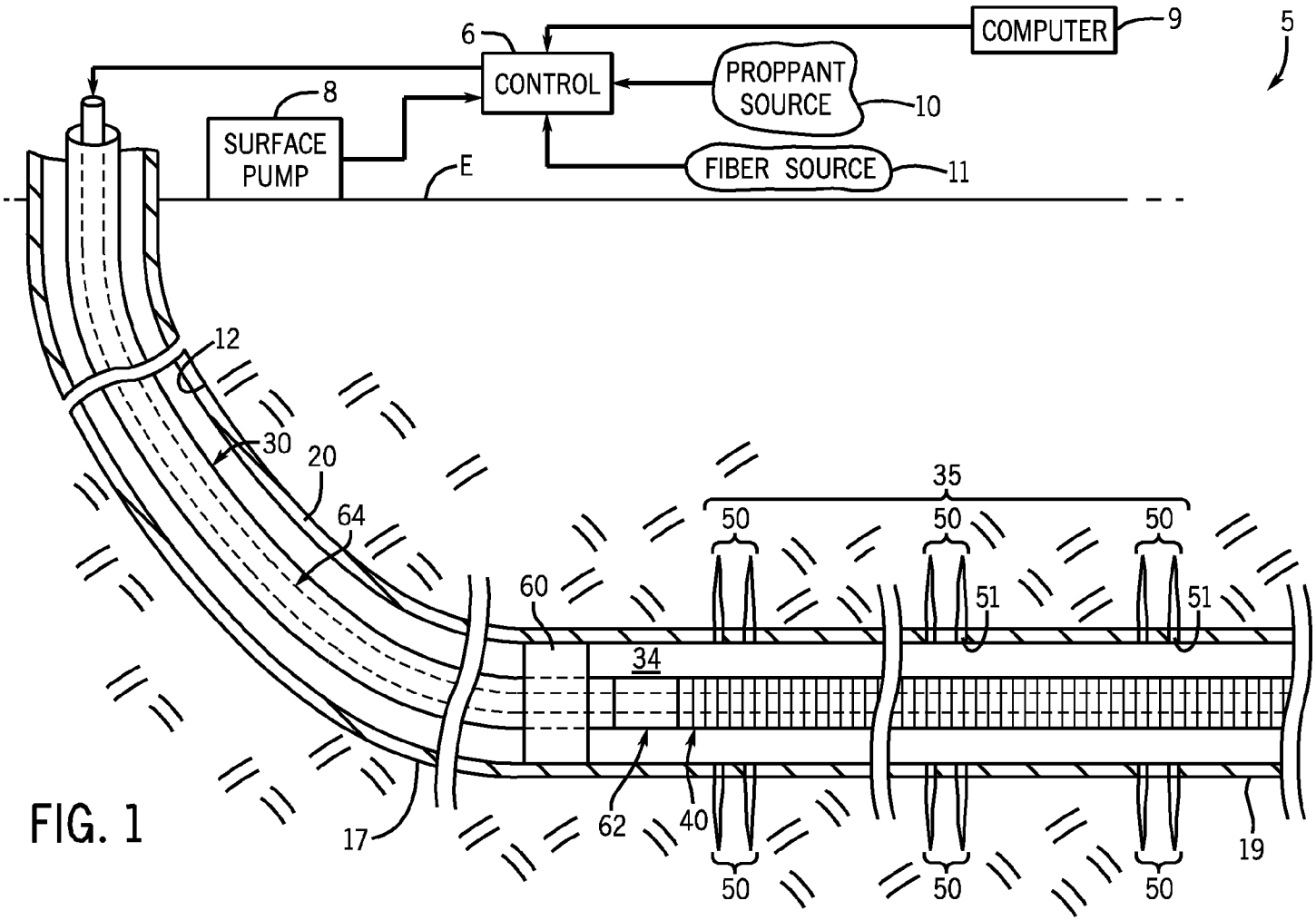
FIG. 1 is a schematic diagram of a well according to an example implementation.

In the following description, numerous details are set forth to provide an understanding of features of various embodiments. However, it will be understood by those skilled in the art that the subject matter that is set forth in the claims may be practiced without these details and that numerous variations or modifications from the described embodiments are possible.

As used herein, terms, such as "up" and "down"; "upper" and "lower"; "upwardly" and downwardly"; "upstream" and "downstream"; "above" and "below"; and other like terms indicating relative positions above or below a given point or element are used in this description to more clearly describe some embodiments. However, when applied to equipment and methods for use in environments that are deviated or horizontal, such terms may refer to a left to right, right to left, or other relationship as appropriate.

In general, systems and techniques are disclosed herein for purposes of completing a given zone, or stage, of an injection well in process that includes running a screen assembly into the stage and installing a fiber-based material in the stage for purposes of preventing proppant migration. More specifically, systems and techniques are disclosed herein for purposes of forming a gravel pack and/or fracture pack in the stage, which is formed from a mixture of proppant and fiber and using the fiber-based material to inhibit (prevent, substantially inhibit, and so forth) movement, or migration, of the proppant due to injection flows, cross flows, and so forth.

More specifically, in accordance with example implementations, the gravel pack and/or fracture pack may be formed in part from a man-made proppant or from a naturally-occurring proppant. When used as part of a gravel pack in the well annulus, the proppant serves as a filtering substrate to inhibit the flow of unconsolidated particulates, or "sand," into the well equipment from flowing into the screen during a crossover flow (during shut-in, for example) of the well. The fracture pack includes proppant that is placed into the fractures of the corresponding fracture network of the formation for purposes of enhancing well productivity for production wells and enhancing injectivity for injection wells. The gravel and fracture packs further include fibers that are activated to form a net to retain the proppant and prevent its migration. One way to activate the fibers uses the temperature of the downhole environment, which increases when fluid is no longer being pumped downhole. In this manner, after the fibers reach an activation temperature, the fibers acquire adhesive properties and adhere, or "stick," to each other to form a mesh. In accordance with some implementations, the fibers are multicomponent fibers, and adhesive properties of the fiber are imparted by the outer sheath of the multicomponent fiber.

Other techniques may be employed to reduce or regulate the fiber activation time. For example, in further implementations, steam, a heated gas or another fluid may be pumped into the well to reduce/regulate the activation time of the fibers. Moreover, the fibers may be activated in other ways, in accordance with further implementations. In this manner, depending on the particular implementation, the fibers may be activated using pressure, time (i.e., the fibers may be activated after waiting for a certain time interval after the fibers are deployed), chemistry, pH, water salinity, downhole chemical reaction, phase transition, and so forth. Thus, many variations are contemplated, which are within the scope of the appended claims.

Without the use of a fiber-based gravel pack and/or fracture pack, a number of situations may exist in maintaining proper control over the well. For example, proppant in the fracture may be displaced further towards the fracture wings during the injection, and gravel from the annulus may be displaced into the fracture. This process results in voids in the annular pack and in the fracture pack, which may result in sand erosion or in "sand fill." Due to the introduction of fibers, however, such displacement of the gravel/proppant pack is precluded or at least significantly mitigated, or inhibited.

The inclusion of the fibers in the fracture pack prevents or significantly inhibits migration of the proppant during an injection flow. In this manner, without the fiber-based material, the fracture width gradually increases accommodating washed proppant in the region apart from the wellbore. Techniques and systems are further disclosed herein for purposes of reinforcing the fracture tips (the distal ends of the fractures) for purposes of preventing proppant migration.

Referring to FIG. 1, as a more specific, non-limiting example, in accordance with some implementations, an injection well 5 includes a wellbore 12, which may traverse one or more formations (as a non-limiting example). In general, the wellbore 12 extends from a heel end 17 to a toe end 19 through one or multiple injection zones, or injection stages, of the well 5. In this regard, the wellbore 12 may, in general be, positioned next to at least one production well (not shown), such that the injection of fluid (water, for example) via the well 5 into the surrounding formation(s) enhances production in the nearby production well(s).

For the example of FIG. 1, the wellbore 12 extends into a particular injection stage, or zone 35; and the wellbore 12, including the section of the wellbore 12 extending into the zone 35, is cased by a tubular string called a "casing 20," which, in general, lines and supports the wellbore 12. In general, FIG. 1 depicts the well 5 in a state after a perforating operation has been performed for purposes of creating/enhancing flow into the stage 35. In this manner, a prior perforating operation has been performed in the well 5 to form various sets of perforation tunnels 50. In this regard, one or more perforating guns may have been previously deployed in the well 5 within the stage 35; and shaped charges of these guns may have been fired at various locations to form perforation jets to form corresponding openings 51 in the casing 20, as well as corresponding perforation tunnels 50 into the surrounding formation(s).

It is noted that FIG. 1 merely depicts an example, as hydraulic communication may be enhanced in other ways, in accordance with further implementations. In this manner, in accordance with further implementations, an abrasive jetting tool may have been previously deployed in the wellbore 12 for purposes of abrading the casing 20 at selected locations. Thus, many variations are contemplated, which are within the scope of the appended claims.

As depicted in FIG. 1, a tubing string 30 extends downhole into the wellbore 12 and contains a screen assembly 40 that is positioned inside the injection zone 35. As illustrated in FIG. 1, for this example, the tubing string 30 may contain at least one packer 60, which is set (radially expanded) to form an annular seal between the exterior of the tubing string 30 and the interior surface of the casing string 20. The packer 60 may further contain dogs, or slips, that, when the packer 60 is set, radially extend to anchor the packer 60 (and tubing string 30) to the casing 20, in accordance with some implementations. In accordance with example implementations, the packer 60 may be initially unset when the tubing string 30 is deployed in the well 5 and thereafter set to form an annular seal between the tubing string 30 and the interior surface of the casing 20 as well as anchor the tubing string 30 to the casing 20. In general, the packer 60 may be one of numerous different types of packers, such as a weight-set packer, a hydraulically-set packer, a mechanically-set packer, an inflatable packer, a swellable packer, and so forth.

The screen assembly 40, in general, contains one or more screens (wire mesh screens, wire-wrapped screens, and so forth) that serve as a filter media having openings that are sized to isolate a central passageway of the tubing string 30 from soon to be deposited proppant and fiber-based material, which forms the gravel pack and surrounds the screen assembly 40 in an annulus 34 between the exterior of the screen assembly 40 and the interior of the casing 20.

In general, FIG. 1 depicts the well 5 in a state after the above-described perforating operation has been performed but before a combined fracturing and gravel packing operation is performed. It is noted that many variations are contemplated, which are within the scope of the appended claims. For example, although FIG. 1 depicts a lateral wellbore, the systems and techniques that are disclosed herein may likewise be applied to vertical well segments. Additionally, the techniques and systems that are disclosed herein may be applied to land-based wells as well as subsea wells, in accordance with further implementations.

Using the equipment depicted in FIG. 1, a combined gravel packing and fracturing operation (also called a "frac-pack operation" herein) may, in general, proceed as follows. For the example of FIG. 1, a land-based well is illustrated. However, it is understood that the systems and techniques that are disclosed herein may likewise apply to subsea wells. Thus, many implementations are contemplated, which are within the scope of the appended claims. At least one surface pump 8 (disposed at an Earth surface E of the well 5) communicates fluid into a central passageway of the tubing string 30 so that the fluid flows downhole through the central passageway to a crossover tool 62, which is disposed at the uphole end of the stage 35. The communicated fluid exits the tubing string 30 at the crossover tool 62 and enters the annulus 34.

In the annulus 34, the fluid that leaves the tubing string 30 during the frac-pack operation may flow along two different paths. Along a first path, the fluid is communicated into fractures of a fracture network that is formed in the near-wellbore formation region due to the pressurization of fluid by the pump 8. Along a second path, the fluid returns to the central passageway of the tubing string 30 through the screen assembly 40; and solid particles that have sizes larger than the openings, or slits, of the screen assembly 40 are filtered out by the screen assembly 40 and thus, remain outside of the screen assembly 40.

As depicted in FIG. 1, the well 5 may include a wash pipe 64 that extends downhole into the tubing string 30 and into the stage 35. The wash pipe 64 communicates the fluid that returns through the screen back to the crossover tool 62, which returns the fluid to the annulus between the tubing string 30 and the casing string 20 for its return to the Earth surface E.

For purposes of preventing proppant migration during an injection operation in the well 10 as well as preventing proppant migration due to cross-flows when the well 10 is shut-in, fibers are selectively added in at least one phase of the frac-pack-operation. In general, these fibers, once activated downhole due to the temperature of the downhole environment obtain adhesive properties and adhere, or stick, to each other forming a net, which traps and prevents the displacement of the proppant. In general, in the context of this application, "activation" of the fibers refers to imparting a property to the fibers, which allows the fibers to form a net. One way in which the fibers may be activated to form a net is disclosed in PCT Application Publication No. WO2009/079231, entitled "METHODS OF CONTACTING AND/OR TREATING A SUBTERRANEAN FORMATION, which published on Jun. 25, 2009 (hereinafter called the "'231 application").

The fibers that are used may have various shapes, aspect ratios, morphology structures and chemical compositions, depending on the particular implementation. In general, the fibers may be added to a fluid that is communicated downhole into the stage 35 with proppant and/or may be added to a fluid that is communicated downhole into the stage 34 without proppant, as further disclosed herein. Moreover, the fiber-to-proppant concentration (weight ratio, for example) may be selectively regulated in one or more phases of the frac-pack operation, as further disclosed herein, for purposes of forming a fracture and/or gravel pack that inhibits (entirely prevents or substantially prevents, for example) proppant migration.

As non-limiting examples, fibers may include glass, aramid, nylon and other natural and synthetic organic and inorganic fibers and metal filaments. In accordance with some implementations, the fibers may be single component fibers. As non-limiting examples, the fibers that are disclosed in one or more of the following patents may be used: U.S. Pat. No. 5,330,005, entitled, "CONTROL OF PARTICULATE FLOWBACK IN SUBTERRANEAN WELLS", which issued on Jul. 19, 1994; U.S. Pat. No. 5,439,055, entitled, "CONTROL OF PARTICULATE FLOWBACK IN SUBTERRANEAN WELLS," which issued on Aug. 8, 1995; U.S. Pat. No. 5,501,275, entitled, "CONTROL OF PARTICULATE FLOWBACK IN SUBTERRANEAN WELLS", which issued on Mar. 26, 1996; U.S. Pat. No. 6,172,011 entitled, "CONTROL OF PARTICULATE FLOWBACK IN SUBTERRANEAN WELLS," which issued on Jan. 9, 2001; and U.S. Pat. No. 5,551,514, entitled, "SAND CONTROL WITHOUT REQUIRING A GRAVEL PACK SCREEN," which issued on Sep. 3, 1996.

In further implementations, the fibers may be multi-component fibers, which contain, in general, a rigid core (nylon, for example) that provides mechanical stability and an outer sheath (a sheath made of Surlyn®, for example) that surrounds the inner core. As non-limiting examples, multi-component fibers may be used such as the ones disclosed in the following references: the '231 application; PCT Application Publication No. WO2009/079233, entitled, "PROPPANTS AND USES THEREOF," which published on Jun. 25, 2009; PCT Application Publication No. WO2009/079234 entitled, "METHODS OF TREATING SUBTERRANEAN WELLS USING CHANGEABLE ADDITIVES," which published on Jun. 25, 2009; and PCT Application Publication No. WO2009/079235, entitled, "FRACTURING FLUID COMPOSITIONS COMPRISING SOLID EPDXY PARTICLES AND METHODS OF USE," which published on Jun. 25, 2009.

Still referring to FIG. 1, in general, for purposes of performing the gravel packing and/or fracture packing operations, the well 5 includes at least the following equipment that is disposed at the Earth surface E. A surface pump 8 delivers the fluid (the pad fluid, a carrier fluid having proppant, a carrier fluid having proppant and fibers, and so forth) to the central passageway of the tubing string 30 for purposes of communicating the fluid downhole. The surface pump 8 may be operated accordingly to pressurize the fluid downhole for purposes of fracturing the downhole formation (s).

The surface equipment includes such other equipment as control valves 6, a carrier fluid source 6, a fiber source 11, a proppant source 10 and control valves 6. As also depicted in FIG. 1, a computer 9 may also be employed for such purposes as regulating the control valves 6, monitoring downhole conditions via one or more downhole temperature and/or pressure sensors; executing program instructions to simulate downhole conditions to predict when the downhole fibers are activated; executing program instructions to simulate downhole conditions to predict when the downhole environment allows the fibers to be introduced without activating the fibers; controlling relative fiber and proppant concentrations; controlling schedules for varying relative fibers and proppant concentrations; and so forth. Although depicted as being local to the well 5 in FIG. 1, it is understood that the computer 9 may be remotely connected (via a satellite, Internet connection, wide area network connection (WAN), and so forth), in accordance with example implementations. Moreover, although depicted as being contained in a box, the computer 9 may be distributed computing system, in accordance with some implementations.

Figure 2:
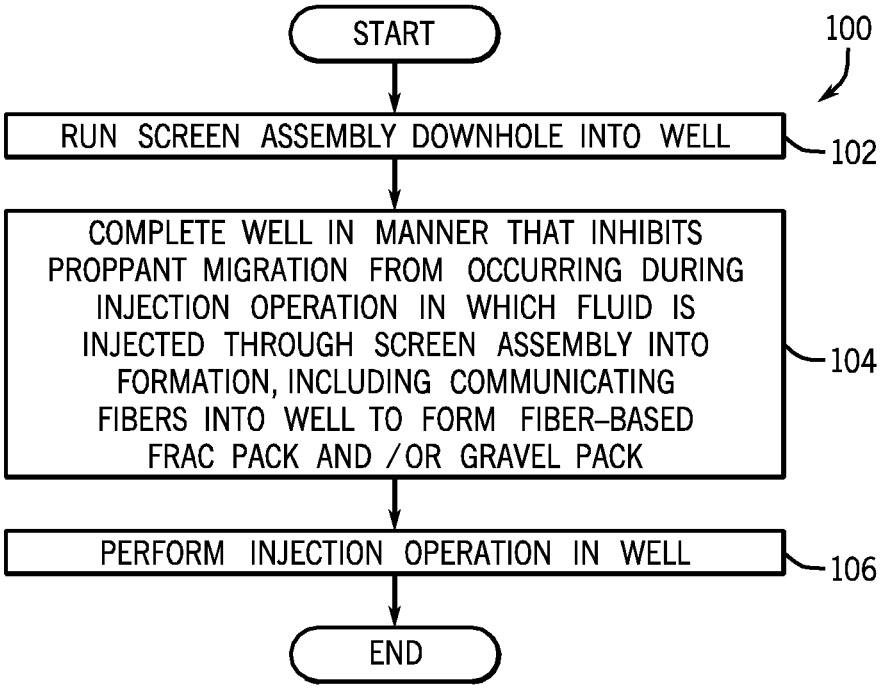
FIGS. 2, 3, 4, 5 and 6 are flow diagrams depicting techniques to complete and use an injection well according to example implementations.

Referring to FIG. 2, in accordance with some implementations, a technique 100 includes running (block 102) a screen assembly downhole into a well and completing (block 104) the well in a manner that inhibits proppant migration from occurring during an injection operation in which fluid is injected through the screen assembly into a surrounding formation. This completion includes communicating fibers into the well to form a fiber-based fracture pack and/or gravel pack in the well, pursuant to block 106.

Figure 3:
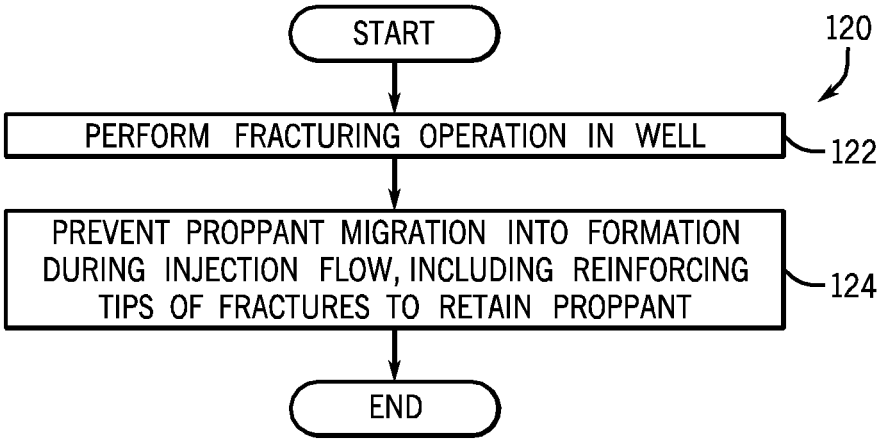

Referring to FIG. 3 in accordance with example implementations, which are disclosed herein, proppant migration from the fractures is inhibited by reinforcing the tips of the fractures for purposes of retaining the proppant in the fractures. In this regard, the "fracture tip" refers to the distal end of the fracture, where the proximate end of the fracture is the originating point of the fracture. More specifically, pursuant to a technique 120 that is depicted in FIG. 3, a fracturing operation is performed in a well, pursuant to block 122. Proppant migration is inhibited during an injection flow, pursuant to block 124, by reinforcing tips of fractures to retain the proppant. In accordance with some implementations, the fiber material is used to form a web, or net, at the fracture tips for purposes of preventing proppant migration. The properties of the formed mesh (pack strength, pack permeability, and so forth), in turn, in accordance with example implementations, are controlled by varying the order and relative concentrations of fiber and proppant, as these materials are communicated into the well.

Figure 4:
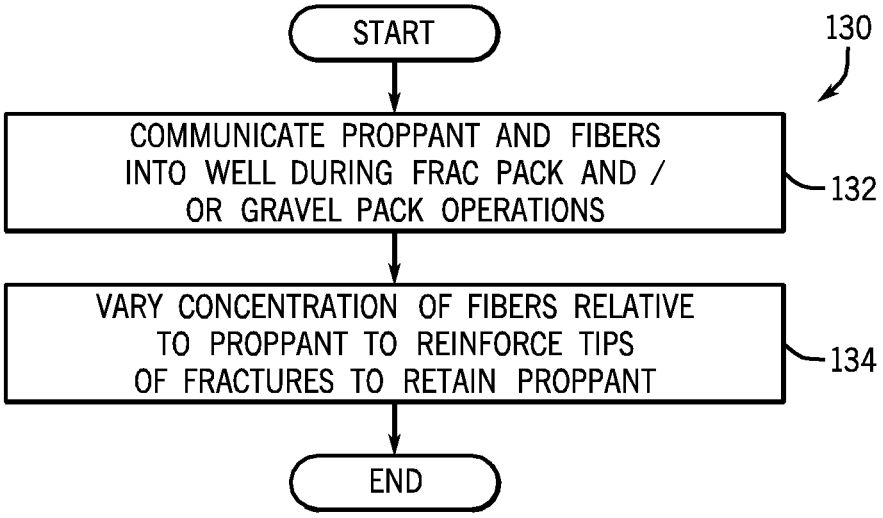

More specifically, referring to FIG. 4, a technique 130, in accordance with some implementations, includes communicating (block 132) proppant and fibers into a well during a fracture packing operation. A concentration of the fibers is varied (block 134) relative to the proppant for purposes of reinforcing the tips of fractures to retain the proppant.

As a more specific example, in accordance with example implementations, after a pad (carrier fluid without proppant and fibers, for example) is pumped into the well in the initial fracturing operation for purposes of creating the fracture network, a higher concentration of fibers (relative to the proppant) is initially pumped into the well.

In accordance with some implementations, the fibers may be pumped into the well before the introduction of any proppant. Due to the relatively high concentration of fibers, the fibers form corresponding meshes, or webs, at the fracture tips for purposes of reinforcing the tips to inhibit proppant migration. In further implementations, after the pumping of the pad into the formation, a mixture of proppant and fibers may be initially introduced into the well. However, regardless of the particular implementation, the fracture tips may be reinforced by increasing the relative concentration of the fibers relative to the proppant (the weight of the fibers to the weight of the proppant) during the initial phases. As a fracturing operation proceeds, the concentration of fibers relative to the proppant decreases.

As a more specific example, in accordance with some implementations, during the later stages of the frac-pack operation, the concentration of the fibers may in the range of 0.01% to 30% by weight of proppant (a concentration of 0.1% to 5% by weight of proppant, as an even more specific example). During the initial stages of the frac-pack operation, however, the concentration of the fibers is increased to at least a 1.5 times higher concentration, such as, for example, a concentration of 0.1% to 50% (a concentration of 0.3% to 10%, as a more specific example), depending on the concentration used in the later stages. It is noted that these concentrations are merely for purposes of non-limiting examples, as other concentrations for the fibers may be used, in accordance with further implementations.

Figure 5:
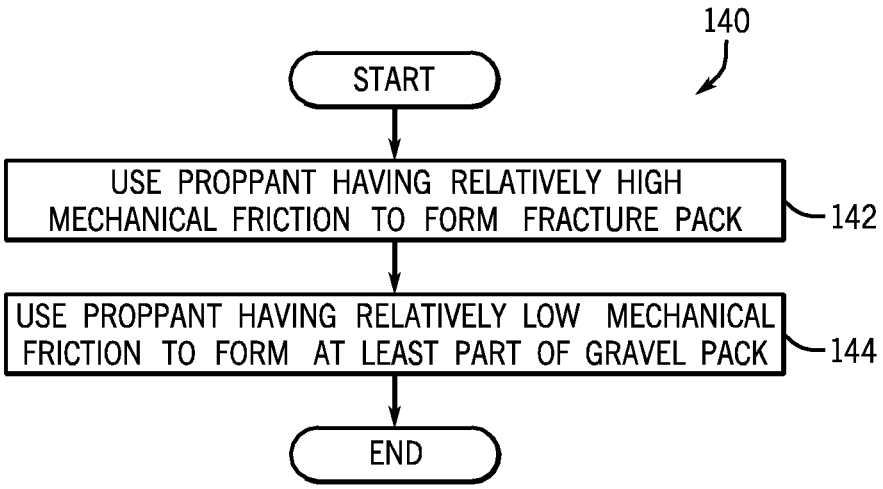

The fracture tips may be reinforced for purposes of inhibiting proppant migration using other techniques, in accordance with further implementations. For example, in accordance with other implementations, a technique 140 (see FIG. 5) includes using (block 142) a proppant that has a relatively high mechanical friction to form the fracture pack; and subsequently, using (block 144) another proppant having a relatively lower mechanical friction to form at least part of the gravel pack. As a non-limiting example, the initially used proppant that has a relatively high mechanical friction may be a proppant that has a relatively large aspect ratio (as compared to the proppant that has the relatively low mechanical friction), although other proppants may be used, in accordance with further implementations.

The friction proppant may be added at any stages of the treatment including, but not limiting to, beginning of the treatment or end of the treatment. Moreover, the friction proppant may be added several or many times during the treatment alternating with portions of lower friction proppant.

The fibers may be added at any stages of the treatment and may be added as different combinations of proppants having different associated friction for the different stages. Thus, many variations are contemplated, which are within the scope of the appended claims.

Figure 6:
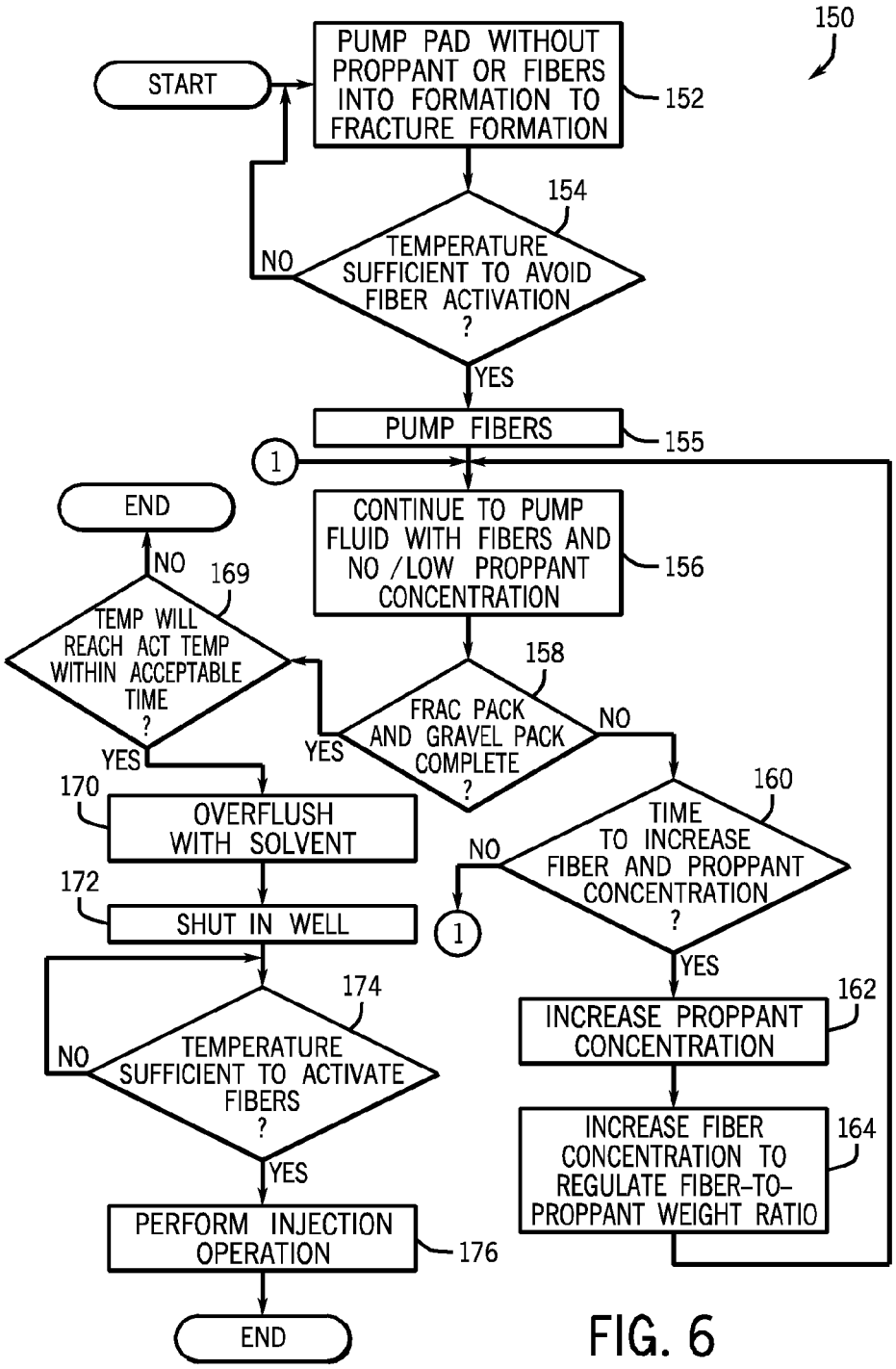
Figure 7:
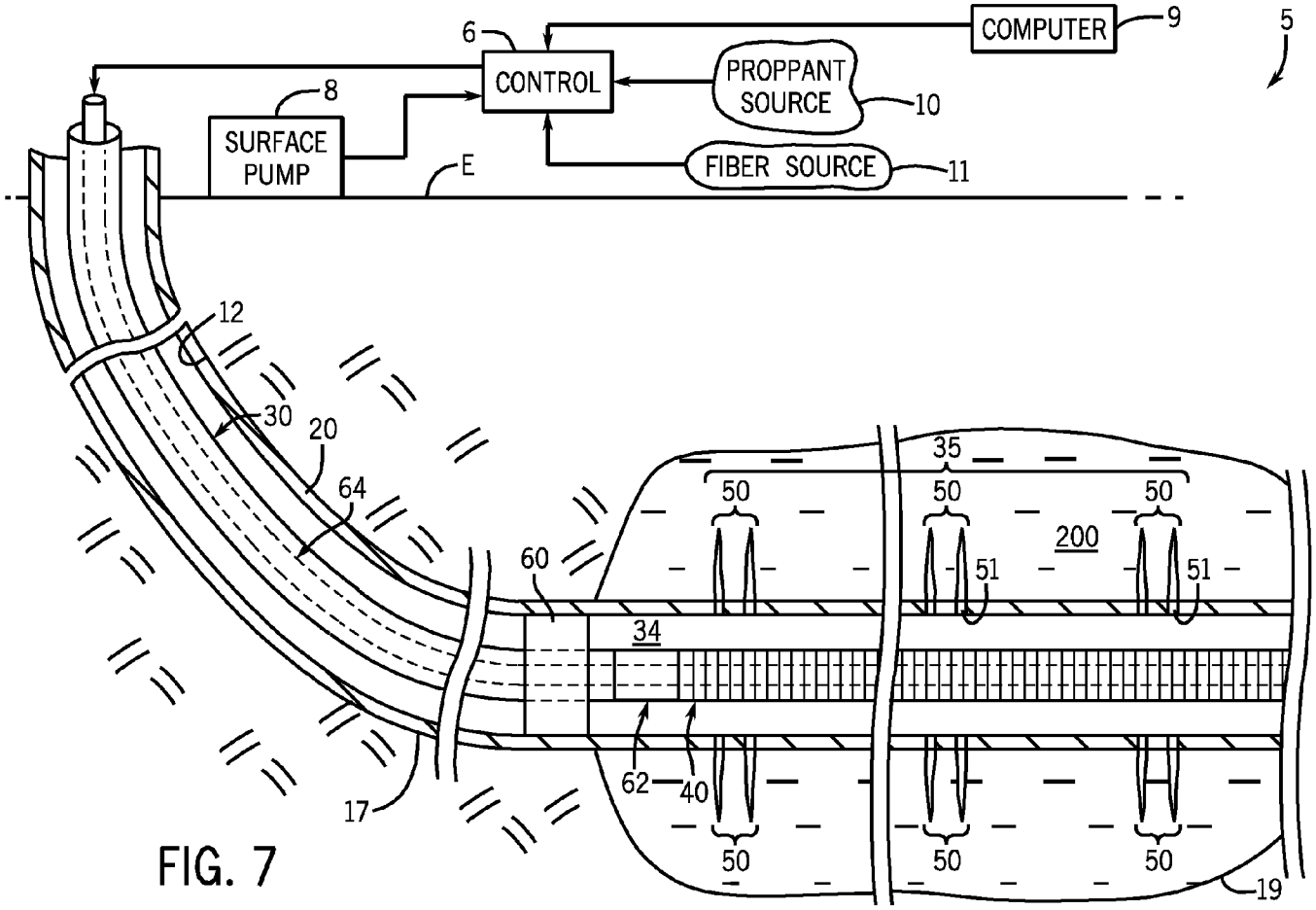
FIG. 7 is a schematic diagram of the well of FIG. 1 illustrating introduction of a pad into the well according to an example implementation.

Referring to FIG. 6, in accordance with example implementations, the well 5 may be completed pursuant to a technique 150. Referring to FIG. 6 in conjunction with FIG. 1, in the technique 150, a pad (a carrier fluid without proppant or fibers, for example) is pumped (block 152) into the formation. Based on one or more downhole measurements (acquired via one or more downhole sensors, for example), the pumping of the pad continues or, alternatively, further operations are suspended until a determination is made (decision block 154) that the downhole temperature is sufficiently low enough for the pumping of fibers into the annulus 34. In this manner, the pumping of the pad forms an outer barrier 200 in the formation, as illustrated in FIG. 7. The introduction of the pad, in general, lowers the temperature in the stage 35, and the pad is pressurized to initiate the fracturing to form the corresponding fracturing network. Due to the cooling, the downhole temperature decreases to a threshold that is below the temperature used to activate the subsequently introduced fibers.

Therefore, pursuant to the technique 150, when a determination is made (decision block 154) that the downhole temperature is sufficiently low enough to avoid fiber activation, a second phase begins in which a fluid containing fibers and a relatively low concentration of proppant (or alternatively, no proppant concentration) is pumped, pursuant to block 154, into the zone. This determination may be made via the computer 9 through execution of a computer simulation application that uses one or more downhole sensor inputs, in accordance with some implementations. Other ways may be used to assess whether the downhole temperature is sufficiently low enough to avoid fiber activation, in further implementations.

Next, a subsequent phase begins in which fluid containing fibers and proppant are pumped into the stage 35, pursuant to block 155. As the pumping of the second phase continues, the fiber and proppant concentration are gradually increased. In accordance with some implementations, the fiber-to-proppant weight ratio is maintained relatively constant so that as the fiber concentration increases, the proppant concentration increases to maintain this relatively constant ratio. In further implementations, the fiber-to-proppant weight ratio may vary over time. Thus, as depicted in FIG. 6, a determination is made (decision block 158) whether the second phase is complete. If not, a determination is made (decision block 160) whether it is time to increase the fiber and proppant concentration. If so, the proppant concentration is increased (block 162) and the fiber concentration is increased (block 164) to regulate the desired proppant-to-fiber weight ratio. Control then returns to block 156 to continue to pump fluid fibers with a relatively low but increasing proppant concentration, as the second phase progresses. As the second phase progressives, the fracture pack is first formed, and thereafter, the proppant, fluid and fiber mixture form the gravel pack in the well annulus 34.

At the conclusion of the second phase, the fracture and gravel packs are complete. Before the well is shut-in (pursuant to block 172), in accordance with example implementations, the formation may be overflushed (block 170) with a hydrocarbon-based solvent, which is injected into the fractures. The determination of whether the formation is to be overflushed is first determined (pursuant to decision block 169) based on whether the bottomhole temperature is predicted to reach the activation temperature within an acceptable time. In this regard, the prediction may be determined using a simulation and/or based on downhole measurements, depending on the particular implementation. The hydrocarbon-based solvent, in turn, decreases the activation temperature of the fibers. As a more specific example, depending on the particular implementation, the solvent may be one of the following: toluene, pentane, hexane or kerosene. In accordance with some implementations, the solution of the solvent may be 100% of one of these hydrocarbons, although different mixtures may be used, in accordance with further implementations.

After the shut-in of the well, pursuant to block 172, further operations are suspended until a determination is made, pursuant to decision 174, that the downhole temperature is sufficient to activate the fibers. In this manner, after shut-in, the downhole temperature generally rises, and a determination of the downhole temperature may be aided through one or more downhole measurements and through a simulation application that is executed by the computer 9 (see FIG. 1), in accordance with some implementations. When a determination that downhole conditions are sufficient to activate the fibers, then an injection operation may be performed, pursuant to block 176.

Figure 9:
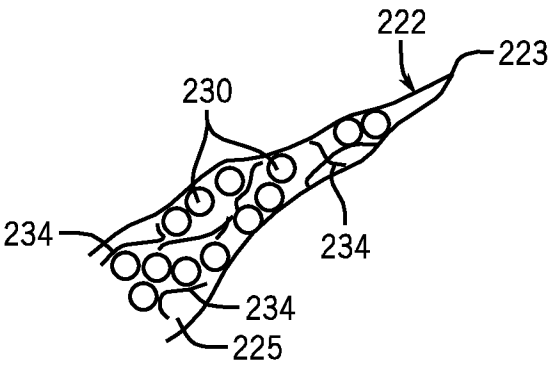
FIG. 9 is an illustration of a fiber-based material deployed in a fracture according to an example implementation.
Figure 8:
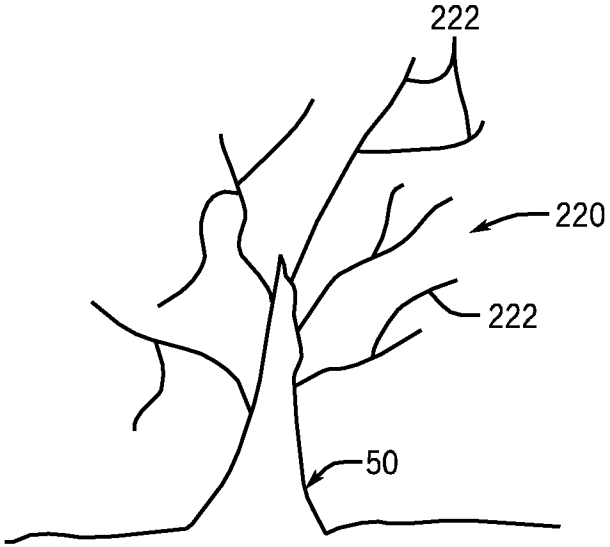
FIG. 8 is an illustration of an example fracture network according to an example implementation.
Figure 10:
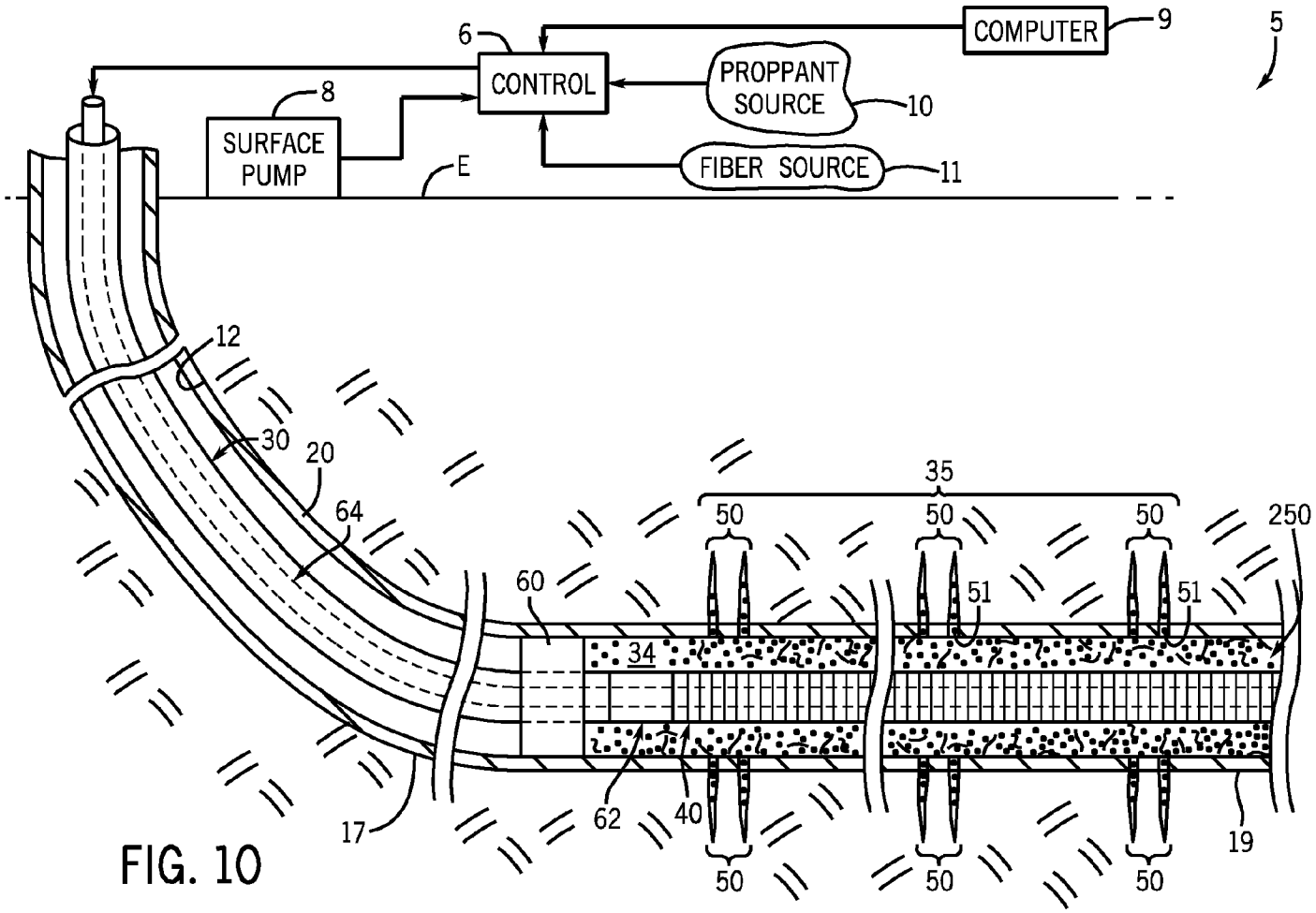
FIG. 10 is a schematic diagram of the well of FIG. 1 after a gravel packing operation according to an example implementation.

FIG. 8, in general, depicts a portion of a fracture network 220 that may be formed due to the introduction and pressurization of the pad. FIG. 9 depicts the composite material formed from proppant 230 and fibers 234 in an example fracture 222. In general, this composite mixture prevents proppant migration during an injection operation.

Other variations are contemplated and are within the scope of the appended claims. For example, in accordance with some implementations, the injection operation may use a downhole fluid injection pressure that exceeds the maximum downhole fluid pressure that was used in the fracturing operation. In further implementations, the injection operation may use a downhole fluid injection pressure that is less than the maximum downhole pressure that was used in the fracturing operation.

As another example, in accordance with some implementations, the ratio of the fiber length to the screen opening is within a predefined range. For example, in accordance with some implementations, the screen may be a wire-wrapped screen that has a screen opening, or "slit opening," between adjacent windings of the screen. This slit opening, in turn, is selected based on the fiber length. In accordance with some implementations, the fiber length may be approximately six millimeters (mm); and the slit opening may be selected such that a ratio of the fiber length to the slit opening is within a range of approximately one to five hundred. Therefore, as a non-limiting example, a fiber length of six millimeters (mm) and a slit opening of 200 microns (μm) produces a ratio of thirty. The ratio may be in a range of one to one thousand (ten to three hundred, as a more specific example), in accordance with some implementations. Thus, many variations are contemplated and are within the scope of the appended claims.

In further implementations, the screen assembly 40 may be a mesh screen, and the screen opening, or "nominal opening," of the screen assembly 40 may, in conjunction with the fiber length, form a range of approximately one to five hundred for the fiber length to screen opening ratio. As a non-limiting example, the fiber length-to-nominal opening ratio may be in the range of one to one thousand, in accordance with some implementations.

While a limited number of examples have been disclosed herein, those skilled in the art, having the benefit of this disclosure, will appreciate numerous modifications and variations therefrom. It is intended that the appended claims cover all such modifications and variations.

What is claimed is:

1. A method comprising:

completing a well, the completing comprising installing a tubing string comprising a screen in the well, installing a fiber-based material in a formation fracture tip outside of the screen, wherein the fibers are introduced downhole without activating the fibers, packing the fracture with proppant, and activating the fibers to adhere together to form a mesh in the fracture tip;

then using the completed well as an injection well in which a fluid is communicated into the tubing string to cause an injection flow to be communicated in a fluid flow path from an interior of the tubing string, through the screen and into the formation; and retaining the proppant in the mesh to inhibit proppant wash due to increasing width of the fracture during the injection flow.

2. The method of claim 1, wherein completing the well further comprises installing a fiber-based gravel pack in a well annulus outside of the screen.

3. The method of claim 1, wherein the fracture comprises a fracture network.

4. The method of claim 1, wherein the screen comprises an opening, the fiber-based material comprises fibers having a fiber length, and a ratio of the fiber length to the opening is within a range of one to five hundred.

5. The method of claim 4, wherein the screen comprises a wire-wrapped screen, and the opening comprises a slot opening of the wire-wrapped screen.

6. The method of claim 4, wherein the screen comprises a mesh screen, and the opening comprises a nominal opening of the mesh screen.

7. The method of claim 1, wherein the fibers are selected from the group consisting of single component fibers, bicomponent fibers and multicomponent fibers.

8. The method of claim 1, wherein the fibers are adapted to be activated in response to a predetermined time elapsing after the fibers are deployed.

9. The method of claim 1, further comprising:

triggering the fiber activation in response to at least one of the following: a temperature change, a pH change, a pressure change, a chemical reaction and phase transition.

10. The method of claim 1, wherein completing the well further comprises:

communicating fibers into the well into an annulus of the well and into fractures of the well;

communicating a solvent into the formation to decrease an activation time of the fibers;

shutting in the well; and regulating a duration of the shutting in to activate the fibers.

11. The method of claim 10, wherein the solvent comprises a hydrocarbon-based solvent.

12. The method of claim 1, further comprising:

reducing an activation time of the fibers, the reducing comprising communicating steam, a heated gas or another fluid into the well.

13. The method of claim 1, further comprising selecting the fibers to have an activation temperature above a temperature of the formation, injecting a pad into the formation to cool the formation below the activation temperature, placing the fibers in the fracture tip, and then allowing the temperature of the fibers to increase to or above the activation temperature.

14. A method usable with a well, comprising:

completing the well, wherein completing the well comprises communicating proppant and fibers into the well and activating the fibers to form a mesh, varying a composition of the proppant over time during the communication, and reinforcing tips of fractures of a fracture network with the mesh formed from the activated fibers; and preventing proppant migration into a formation during an injection flow in the completed well in which a fluid is communicated into a tubing string to cause an injection flow to be communicated in a fluid flow path from an interior of the tubing string and into the formation, the preventing comprising the reinforcing tips of fractures with the mesh formed from activated fibers to retain the proppant.

15. The method of claim 14, wherein preventing the proppant migration further comprises:

communicating the proppant and the fibers into the well; and varying a concentration of the fibers relative to the proppant over time during the completing such that the concentration of the fibers relative to the proppant is greater for an earlier stage of the communication than the concentration of the fibers to the proppant for a later stage of the communication.

16. The method of claim 15, wherein preventing the proppant migration further comprises:

communicating a pad fluid into the well, the pad fluid not containing proppant.

17. The method of claim 16, wherein the pad fluid comprises fibers.

18. The method of claim 14, wherein the communication occurs in a plurality of stages and varying the composition of the proppant comprises:

communicating a proppant having high friction in at least one stage of the plurality of stages, and communicating a proppant having a relatively lower friction in at least one other stage of the plurality of stages.

19. The method of claim 14, wherein the completing occurs in a plurality of stages, and communicating the proppant occurs in the at least one of the stages.

20. The method of claim 14, wherein the concentration of fibers relative to the proppant in the earlier stage is at least 1.5 times the concentration of the fibers relative to the proppant in the later stage.

21. A method comprising:

completing a well, the completing comprising installing a tubing string comprising a screen in the well, installing a fiber-based material in a formation fracture tip outside of the screen, packing the fracture with proppant, and activating the fibers to adhere together to form a mesh in the fracture tip;

wherein completing the well comprises varying a composition of the proppant over time during the packing, wherein the varying proppant composition comprises communicating a proppant having high friction in at least one stage of a plurality of stages, and communicating a proppant having a relatively lower friction in at least one other stage of the plurality of stages;

then using the completed well as an injection well in which a fluid is communicated into the tubing string to cause an injection flow to be communicated in a fluid flow path from an interior of the tubing string, through the screen and into the formation; and retaining the proppant in the mesh to inhibit proppant wash due to increasing width of the fracture during the injection flow.

* * * * *